United States Patent [19]

Johansson

[11] 3,965,545

[45] June 29, 1976

[54] BELT BUCKLE

[76] Inventor: Lars Johansson, 631 Hicksville Road, Far Rockaway, N.Y. 11691

[22] Filed: May 28, 1975

[21] Appl. No.: 581,550

[52] U.S. Cl. ..... 24/186; 24/176

[51] Int. Cl.[2] ..... A44B 11/22; A44B 11/24

[58] Field of Search ..... 24/198, 176, 186, 169, 24/166, 172, 173, 174, 74 A, 77, 210, 255 SL, 201 S, 230 SL

[56] References Cited

UNITED STATES PATENTS

| | | | |
|---|---|---|---|
| 2,750,643 | 6/1956 | Rubin | 24/166 |
| 3,162,916 | 12/1964 | McHugh | 24/198 |
| 3,206,816 | 9/1965 | Vilcins | 24/74 A |
| 3,823,443 | 7/1974 | Takabayashi | 24/186 |

FOREIGN PATENTS OR APPLICATIONS

| | | | |
|---|---|---|---|
| 739,173 | 1/1933 | France | 24/169 |
| 759,163 | 1/1934 | France | 24/186 |

*Primary Examiner*—Bernard A. Gelak
*Attorney, Agent, or Firm*—Robert L. Stone

[57] ABSTRACT

A belt buckle formed of a single piece of hard material having a front face and parallel thereto when the buckle is closed, a back face, connected at an adjacent end of each face by two hinges at the sides of each face and an integral frictional wedged prong connected to the other end of one of said faces, essentially perpendicular thereto, which engages the opposite face in a locking manner.

9 Claims, 9 Drawing Figures

FIG. 1
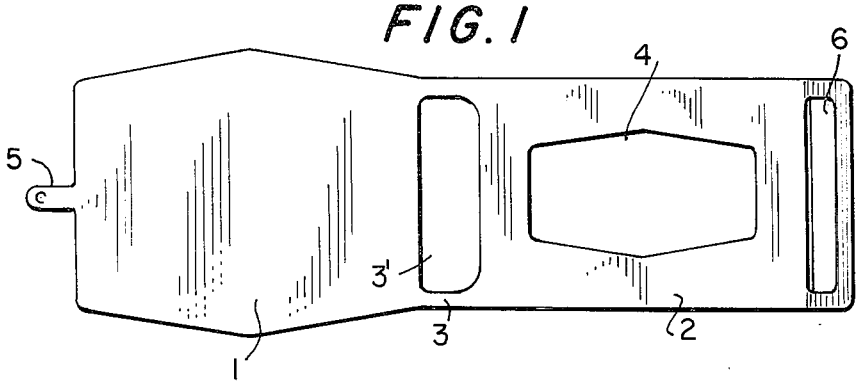
FIG. 2
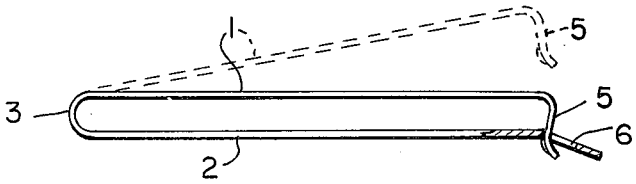
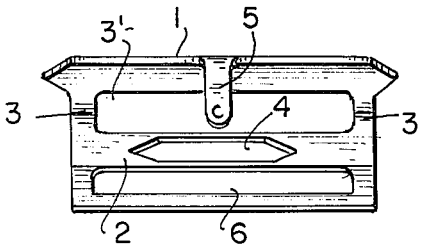
FIG. 3
FIG. 4
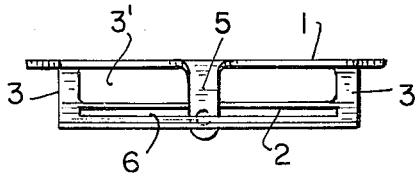
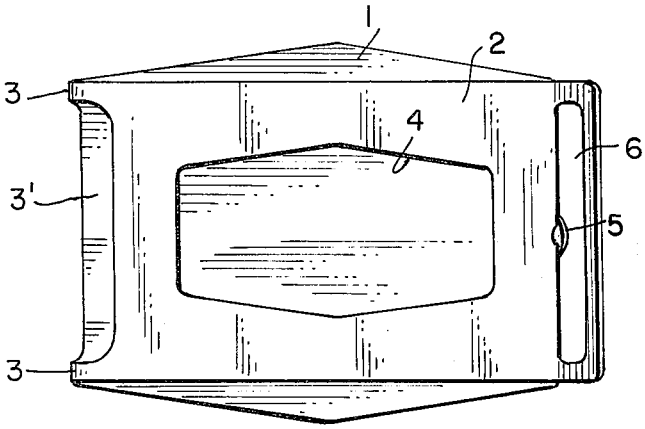
FIG. 5

FIG. 6
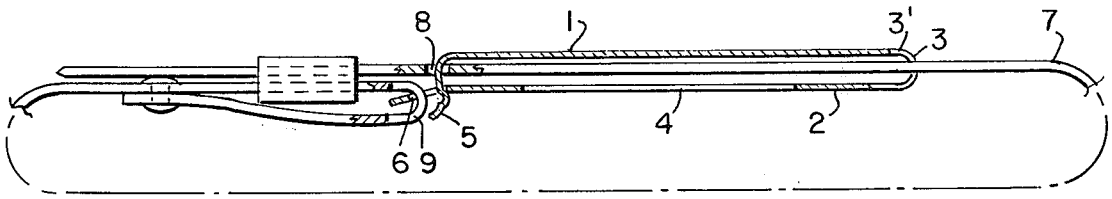
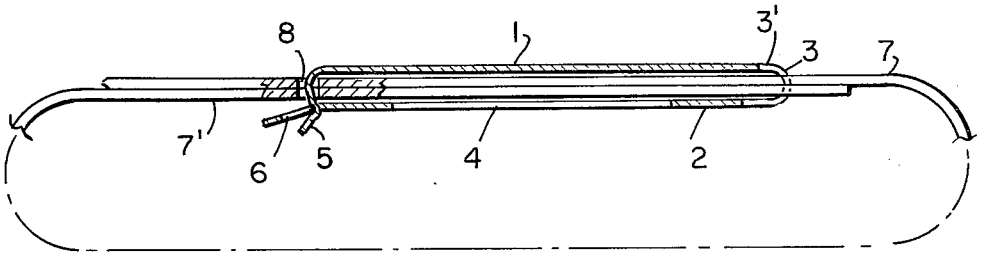
FIG. 7
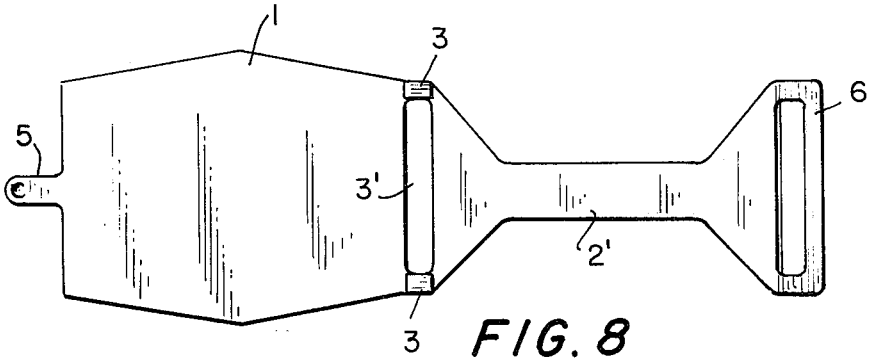
FIG. 8
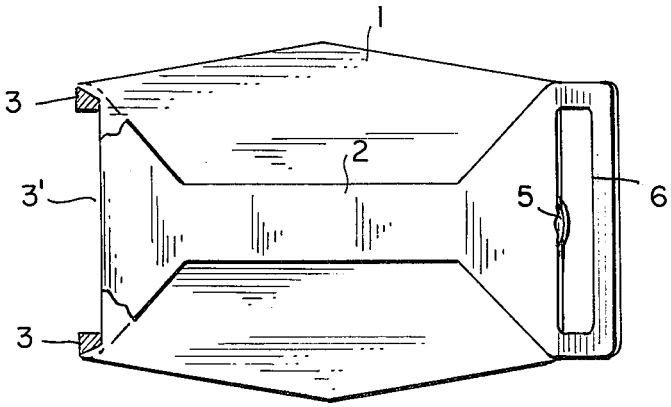
FIG. 9

BELT BUCKLE

This invention relates to a buckle formed of a single piece of hard material.

Buckles are commonly used for securing belts on pants as well as for many other straps. The typical buckle, particularly for securing a belt, is composed of two pieces. Generally, a prong is loosely attached to a separate piece which constitutes the principal part of the body of the buckle. The loose prong is adapted to fit through a hole in a belt or other strap passing through the buckle. Buckles are also known in which a separate arm is attached to the main part of the buckle body and is adapted to secure a belt in place by a pinching action.

Such buckles have the disadvantage that being formed of more than one piece, complex expensive machinery or time-consuming hand labor is required for their assembly. Also, they are prone to breakage or inefficiency after long use due to weakness of the attachment of the pieces.

Belts are also known in which a finger is attached to the face thereof, essentially perpendicularly to the face. Such a finger is adapted to engage a belt or other strap. However, this engagement is typically not very firm and is easily displaced at unwanted times during use.

It is an advantage of this invention that a buckle of a single piece is provided having an integral frictional prong which firmly engages a belt or strap in a positive locking manner. Additional advantages are that a belt locked by the buckle does not crease or become disfigured; a belt engaged by the prong can easily remain engaged if the lock is opened; and the buckle can be operated with one hand. Further advantages of this invention will be apparent from consideration of the following specification.

In accordance with aspects of the invention there is provided a belt buckle formed of a single piece of substantially inflexible material having a front face and, parallel thereto when the buckle is closed, a back face, connected at an adjacent end of each face by two hinges at the sides of each face and an integral frictional wedged prong connected to the other end of one of said faces, essentially perpendicular thereto, which prong engages the opposite face in a positive locking manner.

In a desirable aspect of the invention the face opposite the prong has a bail extending therefrom surrounding the prong when the buckle is closed, which is suitable for securing the buckle to a belt by looping the belt around the bail.

The invention is illustrated in the accompanying drawings. However, it is understood that variations, modifications and alterations can be made which fall within the scope of the claims appended to this specification.

FIG. 1 is a top view of a form typically stamped from a die which after bending froms a belt buckle in accordance with the invention.

FIG. 2 is side view of the buckle formed by bending the form of FIG. 1 with the prong moved from open position (in dotted lines) to closed position (in solid lines).

FIG. 3 is a front view of the buckle of FIG. 2 formed by bending the form of FIG. 1 with the prong in open position.

FIG. 4 is a front view of the buckle of formed by bending the form of FIG. 1 with the prong in closed position.

FIG. 5 is a bottom view of the buckle of FIG. 2 in closed position.

FIG. 6 is a side view of the buckle of FIG. 2 showing a belt engaged at the prong and looped around the bail.

FIG. 7 is a side view showing a buckle with a belt turned around upon itself and doubly engaged by the prong.

FIG. 8 is a side view of an alternate form stamped from a die including guiding and strengthening flaps.

FIG. 9 is a bottom view of the buckle formed by bending the form of FIG. 8 with the prong in closed position.

The present invention provides a belt buckle which can be opened and closed many thousands of times without losing the ability to firmly engage a belt or other strap. The invention will now be described with further more specific reference to the drawings.

FIG. 1 depicts a form typically stamped from a die to provide an area 1 which after bending will be the front face of a buckle and a second area 2 separated therefrom by a void area 3′ between connections 3 between the two areas. After bending at the connections 3 and extension 5 the second area 2 becomes the rear face of the buckle, the connections 3 become hinges and the extension becomes a prong. In a desirable aspect of the invention the second area contains a substantial void space 4 which lightens the weight of the buckle to be formed. Another void area 6 is povided near the end of the form which becomes a bail when the form is bent into a buckle.

FIGS. 2, 3, 4 and 5 illustrate the situation from the side (FIG. 2), front (FIGS. 3 and 4) and rear (FIG. 5) when the form of FIG. 1 is bent at the connections 3 (which serve as hinges) into a buckle with the wedged prong 5 positioned perpendicular to the front face 1 to engage the rear face 2 at an abutment at the inside surface of the bail area 6. The bail area 6 is desirably bent slightly downward (at angle of generally about 25°– 40° preferably about 25°– 30°) from the remainder of the rear face 2. The large void 4 on the rear face is particularly shown in FIGS. 3 and 5.

FIG. 6 illustrates a belt 7 in combination with the buckle of FIG. 2. The prong 5 passes through a belt hole 8 to engage the rear surface 2 at the inside of the bail area 6, in a positive locking manner. The belt 7 passes between the front face 1 and rear face 2 and through the hinges 3. The bottom of the prong 5 extends downward substantially as far as the loop of the belt around the bail. Preferably, there is a small hole (not shown) in the belt which loops around the bail, near the prong.

FIG. 7 illustrates an alternate belt 7 in combination with the buckle of FIG. 2. The belt 7 passes doubly upon itself so that a portion of the belt 7′ is below an upper portion. The prong 5 passes through the belt hole 8 with the belt 7 positioned so that holes in the lower portion 7′ and upper portion are matched. The entire belt 7 passes between the front face 1 and rear face 2 of the buckle and through the hinges 3. The prong 5 engages the rear face 2. In an aspect of this invention the bail 6 shown in FIG. 7 may be absent. Such a buckle can be used with a belt which passes doubly upon itself or to support a hanging strap.

FIG. 8 illustrates an alternate form to that of FIG. 1 typically stamped from a die. The area 2′ which after bending will be the rear face is shaped as a single horizontal bar between the vicinity of the connections 3 and void area 3' and the vicinity of the void area 6. In FIG. 8 the connections 3 are formed thickly so that after bending, the hinges will include integral flaps which assist in guiding a belt through the buckle and also add desirable strength, particularly to a relatively light-weight buckle, such as that having only a bar as its rear face. Area 1 and extension 5 are as depicted in FIG. 1.

FIG. 9 is a rear view of the buckle in closed condition formed by bending the form of FIG. 8 at the thick connections to form flapped hinges 3. The void space 3' is between the hinges 3 and the front face 1 includes a wedged prong 5 which engages the rear face 2 in a frictional locking manner at the inside surface of the bail area 6. The light belt buckle of FIG. 9 has increased springing ability resulting from the small amount of material present on the rear face. It is characterized as having particularly long life. The hinges typically are straight at the interior sides of the hinges and extend upwardly, typically at an angle of about 5°–15°, preferably about 10°.

In the drawings the integral prong is depicted on the front face of the buckle. The invention also includes positioning of the integral prong on the back face, so that the front face is engaged by the prong in a positive locking manner.

In a variation of the invention, two or more frictional prongs may be provided on one face to engage the opposite face in a locking manner. This embodiment is suitable to firmly engage a belt or other strap which has a plurality of holes arranged in a straight line perpendicular to the sides of the belt or strap.

The buckle front and rear faces typically have their smallest width between the two hinges to permit a belt or other strap to pass therethrough, preferably snugly. The faces may be square, rectangular, pentagonal, hexagonal, round, oval, etc. They are typically flat, although the front face may be raised above a plane, as in an arc. They need not be identically shaped and preferably there is less material on the rear, unseen face than on the front face; that is, more material is typically removed from the portion of the form prior to bending which is to be the rear face than is removed from the front face. The presence of void spaces on either or both faces or the presence of a single bar as a face also reduce the amount of plating material or other coating necessary should it be desired to plate or coat the buckle.

Either or both faces may have void areas if a light buckle is desired. Desirably, the front face is complete and attractive designs or pictures can be etched in the front face or coated thereon by adhesive or other means.

The buckle of the invention is formed of hard material and is difficult to bend except at the hinges and the prong. It is preferably formed of steel particularly high carbon steel such as stainless steel or most preferably of spring steel (e.g. C-10-75 and C-10-95). Hard non-ferrous metal, particularly alloys such as bronze, brass, aluminum alloys and copper alloys and hard plastics such as polyesters are also suitable.

Metal buckles may be metal plated or lacquered.

The buckle of the invention is typically given its shape by stamping from a die when formed of metal, such as spring steel.

The buckle is mechanically bent at the connections to position the front face and rear face in parallel relationship when the prong, which is mechanically bent substantially perpendicular to its face and also wedged to permit engaging the opposite face.

With the prong opened and the front face about 10°–15° above its closed position, a metal buckle, preferably of spring steel, is heat treated and tempered. Sharp edges and ridges are removed in a vibrator and the buckle is then polished.

The buckle when formed of resin material is typically formed by injection molding.

The buckle when formed of steel is very hard and can retain effectiveness through thousands of openings and closings for years. It is an aspect of this invention, particularly when the buckle is formed of non-ferrous metal or hard resin to strengthen the buckle for prolonged effectiveness to provide integral flaps at the hinges as shown in FIGS. 8 and 9. The flaps provide additional support and strength to the buckle and also serve to guide the belt or other strap through the buckle and reduce shaving of the belt or other strap at its edges.

Ribs can also be provided on a face preferably the rear face, particularly when the buckle is formed of a material less hard than spring steel, to increse the strength and life of the buckle. The ribs can be embossed on the face at the time the form is shaped.

Although the usefulness of the buckle has been emphasized with regard to belts, particularly for pants, it is understood that the buckle can engage other straps such as those used to support musical string instruments (e.g. guitars), and cameras as well as luggage straps, animal collars, hanging straps, etc.

Variations, alterations and modifications of the buckle described above could be made without departing from the scope of the claims. The above description in intended to be illustrative and not limiting.

I claim:

1. A buckle formed of a single piece of substantially inflexible material having a front face and, parallel thereto when the buckle is closed, a back face, connected at an adjacent end of each face by two hinges at the sides of each face and an integral frictional wedged prong connected to the other end of one of said faces, essentially perpendicular thereto, which prong engages the opposite face in a positive locking manner.

2. The buckle claimed in claim 1 wherein the face opposite the prong has a bail extending therefrom.

3. The buckle claimed in claim 2 wherein the prong extends downwardly from the rear face at an angle of about 250°– 40°.

4. The buckle claimed in claim 3 wherein the downward angle of said prong is about 25°– 30°.

5. The buckle claimed in claim 2 wherein said buckle is formed of steel.

6. The buckle claimed in claim 5 wherein said steel is spring steel.

7. The buckle claimed in claim 2 wherein said rear face has a void area thereon.

8. The buckle claimed in claim 2 wherein said rear face comprises a horizontal bar between the hinges and the bail.

9. The buckle claimed in claim 8 wherein the hinges include integral flaps.

* * * * *